US006161307A

United States Patent [19]

Bourgeois et al.

[11] Patent Number: 6,161,307

[45] Date of Patent: Dec. 19, 2000

[54] FLUID BED SYSTEM FOR COOLING HOT SPENT ANODE BUTTS

[75] Inventors: Thierry Bourgeois, Jonquière; Nigel Ian Steward, Kitimat; Jean-Paul Huni, Jonquière; François Tremblay, Saint-Fulgence; Jean Perron, Chicoutimi, all of Canada

[73] Assignee: Alcan International Limited, Montreal, Canada

[21] Appl. No.: 09/415,437

[22] Filed: Oct. 8, 1999

[30] Foreign Application Priority Data

Dec. 16, 1998 [CA] Canada ..... 2,256,145

[51] Int. Cl.[7] ..... F26B 3/08

[52] U.S. Cl. ..... 34/362; 34/367; 34/393; 34/401; 34/580; 34/66; 34/164; 34/182

[58] Field of Search ..... 34/332, 359, 360, 34/362, 367, 391, 393, 401, 576, 580, 539, 66, 164, 182; 422/144, 198, 212; 110/245; 210/634, 761

[56] References Cited

U.S. PATENT DOCUMENTS

| | | | |
|---|---|---|---|
| 4,305,210 | 12/1981 | Christensen et al. | 34/164 X |
| 4,956,271 | 9/1990 | Milone | 34/580 X |
| 5,042,169 | 8/1991 | Vero | 34/580 X |
| 5,133,137 | 7/1992 | Petersen | 34/580 X |
| 5,182,869 | 2/1993 | Collet et al. . | |
| 5,279,046 | 1/1994 | Vincent | 34/580 X |
| 5,339,774 | 8/1994 | Tang | 110/245 X |
| 5,797,334 | 8/1998 | Weitzel | 110/245 |
| 5,940,982 | 8/1999 | Braun | 34/182 |
| 6,042,369 | 3/2000 | Bergman et al. | 34/580 X |

FOREIGN PATENT DOCUMENTS

| | | |
|---|---|---|
| 24 55 280 | 11/1974 | Germany . |
| WO 93/02772 | 2/1993 | WIPO . |

*Primary Examiner*—Stephen Gravini
*Attorney, Agent, or Firm*—Cooper & Dunham LLP

[57] ABSTRACT

The invention relates to a system for cooling and reducing fluoride emissions from a hot, spent anode butt removed from an electrolysis cell. The system comprises an elongated fluidised bed cooling chamber comprising particles of alumina and conveyor means for transporting a hot, spent anode butt through the fluidised bed. A lower air distributor is provided for injecting fluidising air into the chamber to create the fluidised bed and an upper air distributor is provided which is adapted to direct fluidised particles into contact with the top surface of the hot anode butt, whereby the fluidised bed surrounds the hot anode butt and serves to simultaneously uniformly cool the hot anode butt and significantly reduce fluoride emissions from the hot anode butt.

32 Claims, 5 Drawing Sheets

FLUID BED SYSTEM FOR COOLING HOT SPENT ANODE BUTTS

BACKGROUND OF THE INVENTION

1. Field of the Invention

This invention relates to an apparatus and method for rapid cooling of a hot bulky workpiece, such as a hot spent anode butt, using a fluidised bed. More particularly, the invention relates to cooling hot spent anode butts while simultaneously reducing emission of hydrogen fluoride gases from the hot butts.

2. Discussion of Background Art

Aluminum metal is produced by electrolysis of alumina dissolved in molten cryolite in "potlines" consisting of numerous reduction cells containing cathodes and carbon anodes. In the so-called pre-baked anode technology, as electrolysis proceeds, the carbon anodes are gradually consumed leaving a residual butt that has to be removed and replaced.

Aluminum smelters of this kind tend to release polluting hydrogen fluoride (HF) into the atmosphere. There are three main sources of such HF emissions, namely:

1. Hydrogen fluoride released from the electrolytic cells;
2. Hydrogen fluoride released from hot anode butts as they are removed from the cells and left to cool, often in an anode butt storage building; and
3. HF emitted from the electrolysis bath taken out of the cell during the anode cavity cleaning and dropped in a container near the electrolytic cell at anode change.

Hot anode butts release HF because they absorb quantities of aluminum fluoride during the electrolysis procedure and the aluminum fluoride reacts with moisture in the air to produce HF, according to the following reaction:

$$2AlF_3+3H_2O\ 6HF+Al_2O_3.$$

When anode butts are originally removed from the electrolysis cells, they are at high temperature of approximately 700° C. (1292° F.) and so the indicated reaction proceeds rapidly in the presence of moist air. Once the surface of the anode butts have cooled to a temperature below about 300° C. (524° F.), however, they tend not to release further HF into the atmosphere.

These hot anode butts are presently cooled in air in large areas within an anode rodding plant. This requires large spaces and intense ventilation because of the evolution of the fluoride gases during the early stage of the cooling. Anode change and butt cooling account for a large fraction of the fluoride emissions from a modern smelter.

U.S. Provisional Patent Application Ser. No. 60/060,848 describes an enclosure system for reducing the generation of fluoride gases by hot anode butts. This is in the form of a container made of a heat and fire-resistant material having an interior volume large enough to accommodate at least one anode butt. When the anode butt is within the container, access to atmospheric air is limited thereby reducing the fluoride gas emissions. This system is typically in the form of a movable unit which acts as a general transport device for hot anode butts.

It is known to use fluidised beds for cooling metal workpieces and one such system is described in German Patent Application 24 55 280, published May 26, 1976. It shows a system for heat treating metal workpieces such as crank shafts, cam shafts, etc. using as the fluidised component fine-grained copper powder.

In Wellwood et al., WO 93/02772, published Feb. 18, 1993, a system is described for scrubbing gaseous fluorides from process exhausts. For this purpose, a fluidised bed of alumina particles in a dry scrubber was used to remove gaseous fluorides from airborne aluminum smelter emissions.

Collet et al., U.S. Pat. 5,182,869, issued Feb. 2, 1993, describes a system for cooling anode rods consisting of a continuous cooling tunnel. The cooling medium was forced air, which was forced through the tunnel.

Anode butts are bulky objects having a relatively low surface area to volume ratio. Because of the bulkiness of the hot butts, it was generally believed that a fluidised bed would not be a suitable cooling medium. Thus, it was believed that because of the large heat source available from the butt interior and the low surface area available to cool the butt, the air being used to create the fluidised bed would cause combustion when the oxygen came in contact with the hot surface and would not be effective in cooling the butt.

It is an object of the present invention to develop a suitable fluidised bed cooling system for hot anode butts.

SUMMARY OF THE INVENTION

According to one aspect of the invention, there is provided a system for cooling and reducing fluoride emissions from a hot, spent anode butt removed from an electrolysis cell. The system comprises an elongated fluidised bed cooling chamber comprising particles of alumina and conveyor means for transporting a hot, spent anode butt through the fluidised bed. A lower air distributor is provided for injecting fluidising air into the chamber to create the fluidised bed and an upper air distributor is provided which is adapted to direct fluidised particles into contact with the top surface of the hot anode butt, whereby the fluidised bed surrounds the hot anode butt and serves to simultaneously uniformly cool the hot anode butt and significantly reduce fluoride emissions from the hot anode butt.

It is quite surprising that the fluidised bed can be so successfully used for the cooling of hot anode butts. As mentioned above, these hot anode butts are very bulky objects having a low surface area to volume ratio. The butts are composed of combustible carbonaceous materials and there was a fear that because of the large heat reservoir in the butt interior and the low surface area, combustion might occur when the oxygen of the fluidizing air contacted the hot butt surface.

One way of defining a bulky object within the content of the present invention is an object having a low surface area to volume ratio. This may be expressed in terms of $m^{-1}$ where m is the dimension of the object in metres.

Thus, the hot anode butts of this invention typically have a surface area to volume ratio in the range of about 5 to 30 $m^{-1}$, preferably about 5 to 25 $m^{-1}$, more preferably about 9.5 to 16.5 $m^{-1}$. The invention relates not only to the cooling of hot anode butts of the above configuration, but to the cooling of any bulky hot workpiece having the above surface area to volume ratio. Thus, the invention also broadly relates to a method for cooling a hot solid workpiece having a surface area to volume ratio in the range of 5 to 30 $m^{-1}$. The hot workpiece is moved through an elongated fluidised bed of particulate material, which fluidised bed includes a lower air distributor for injecting fluidising air and an upper air distributor which directs air and fluidised particles into contact with the top of the hot solid workpiece whereby the workpiece is surrounded by the fluidised bed. The workpiece continues its passage through the fluidised bed whereby the hot solid workpiece is uniformly cooled on all surfaces available.

Another way of defining bulkiness according to this invention is in terms of Biot number (Bi) where:

$$Bi=hL/k$$

in which h is the heat transfer coefficient at the solid-fluid interface, L is the characteristic length or the ratio of volume to surface, and k is thermal conductivity of the solid object.

Based on the use of Biot number, a bulky object according to this invention may be defined as one having a Biot number in the range of 5 to 50, preferably about 5 to 25. A typical hot anode butt has a Biot number of about 10.

In order to achieve a uniform cooling of hot, bulky objects such as hot butts in the fluidised bed, it was necessary to include additional circulation of the fluidised medium. This is done by addition of the second air distributor located at the top of the anode butts. The purpose of the second air distributor is to avoid dead fluidising medium (alumina) on the top of the anode butts and to thereby maximize the cooling effect. The air distributor includes an orifice or nozzle located in such manner as to direct the flow of air toward the top surface of the anode butt such as to move the fluidising medium.

Preferably at least two rows of orifices are arranged along the cooling chamber and these two rows of orifices are preferably located at equal lateral spacing along the width of each anode butt. It was also found preferable to locate the orifices at a distance between about 3 cm and 15 cm (1 to 6 in) above the surface of the anode butts. Thus, it has been found that if the orifices are placed too far away from the surface, a layer of alumina remains on top of the anode, while if the orifices are placed too close, there will be only a local effect.

The anode butts being delivered from the pot line are supported on an anode rod and for delivering the hot anode butts through the fluidised bed. The anode rods are supported from a continuous conveyor mechanism at the top of the cooling chamber. It has been found particularly preferable to attach a pair of anode butts to the same rod via a mounting yoke for passing through the fluidised bed.

For entering and exiting the fluidised bed, the continuous conveyor is preferably in the form of a track supporting moving carriages to which the anode rods are attached with the track having inclined sections at each end of the cooling chamber. These inclined sections are adapted to lower a hot anode butt into the fluidised bed at one end of the chamber and lift the anode butt out of the fluidised bed at the other end of the chamber.

For the most efficient operation of this fluidised bed cooling system, it has been found advantageous to limit the volume of the fluidised bed that is occupied by the anode butts. Thus, the volume of the fluidised bed occupied by the anode butts typically comprises about 5 to 40% of the total fluid bed volume, preferably about 5 to 20%, more preferably about 5 to 10%

For an industrial installation, it is preferable to use two fluidised beds situated side-by-side. The length of each fluidised bed portion within which the hot anode butts travel can vary quite widely depending on such factors as the required cooling time of the butt in the bed, the number of butts going through the bed per hour, etc. However, a typical bed has a length of about 25 to 60 m (82 to 197 ft). The two fluidised beds are self-contained units and both may operate simultaneously and independently to process anode butts. In an emergency, one can be shut down and the other can temporarily handle the full hot butt volume.

The anode rods extend up through a narrow slot in the top of each cooling chamber and the ends of the chambers are closed by doors which are arranged to automatically open as the butts pass through. If desired, two sets of doors may be used at each end providing a type of airlock chamber therebetween. Each cooling chamber also includes an exhaust outlet and during operation a slight negative pressure is maintained within the cooling chamber to ensure that all of the exhaust gas passes through scrubbers. This avoids the necessity for hermetic seals which otherwise would be required to prevent fluidising air leakage around the system.

To avoid dust generation in the further handling of the butts, it has also been found advantageous to install a system of air jets at the exit of the cooling chamber to blow alumina off the exiting butts.

The conveying speed and length of the bed are adjusted such that each hot anode butt is exposed to the fluidised medium for approximately two hours. This reduces the temperature of the hot butts from approximately 700° C. (1292° F.) to less than 300° C. (572° F.). At this lower temperature, the anode butts can be left in open air for a period of 4 to 12 hours for further cooling with no risk of producing fluoride gases.

The temperature of the fluidising air is not critical and ambient air may be used. However, it is advantageous to use the coolest air available since about 75% of the cooling of the butts is done by the fluidising air.

The fluidised bed of alumina particles has been found to be not only effective in cooling the hot anode butts but also extremely effective in collecting fluoride gases being emitted. Thus, tests have shown that the fluidised bed has the capability of reducing fluoride emissions from the butts by greater than 73%.

Since the hot anode butts emerging from the potlines are at that point emitting fluorides at a very rapid rate, it is important that they be delivered from the potlines to the fluidised bed as quickly as possible. To assist in preventing random emissions of fluoride gases, the hot anode butts may be transported in a closed mobile carrier. This carrier is typically a self-contained, free-standing, moveable box structure made of heat-resistant material having an interior volume large enough to accommodate at least one anode butt. It is intended for reducing contact between the hot anode butt and moist atmospheric air before the butt has cooled sufficiently to avoid the generation of HF. Fluoride emissions during this transportation period may be further minimized by covering the hot butts with alumina.

The hot anode butts removed from the potlines have a crust of solidified bath which is attached to the top of each butt. This bath crust must be removed at some point during the process. It has been found that this can successfully be done by the use of a vibrating table. Thus, the butts can be cleaned by a vibrating table in either a hot or cold state without fracturing the butt carbon, provided the vibration frequency and amplitude is optimized for the anode system being cleaned. For this purpose, vibrating table technology provided by AISCO Systems Inc. has been found to be very successful. From tests conducted, the preferred technique is to cool the anode butts using the fluidised bed followed by open air cooling while the bath crust remains on the butts and then removing the bath crust from the cooled anode butts by means of vibration technology. However, it is also possible to remove the bath from the hot butts before cooling the butts in the fluidised bed. In this last alternative, it is necessary to take care of the fluoride emission from the hot bath by means of the appropriate gas collection and scrubbing system during hot bath removal and further during hot bath cooling.

DETAILED DESCRIPTION OF THE PREFERRED EMBODIMENTS

Figure 1:
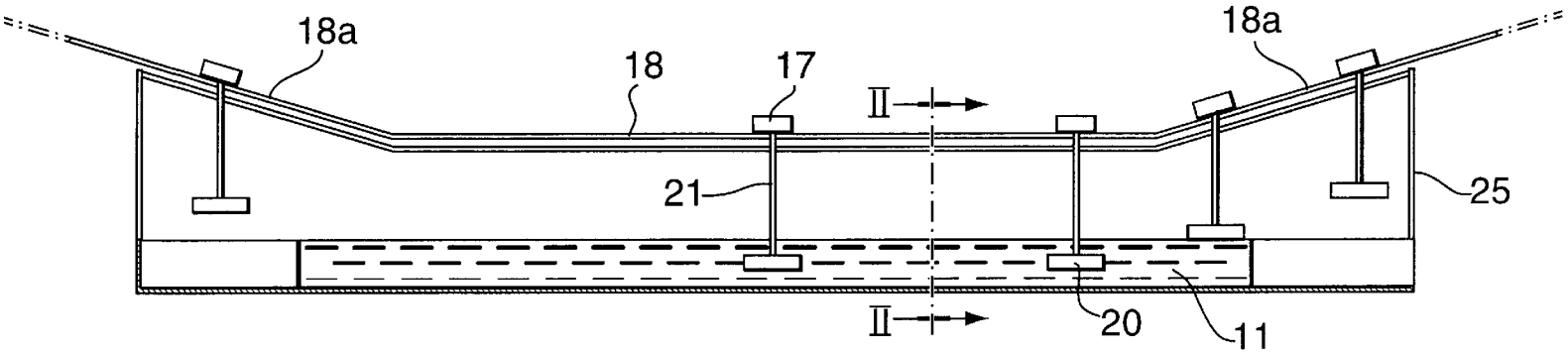
FIG. 1 is a side elevation of a fluidised bed cooling system according to the present invention.
Figure 3:
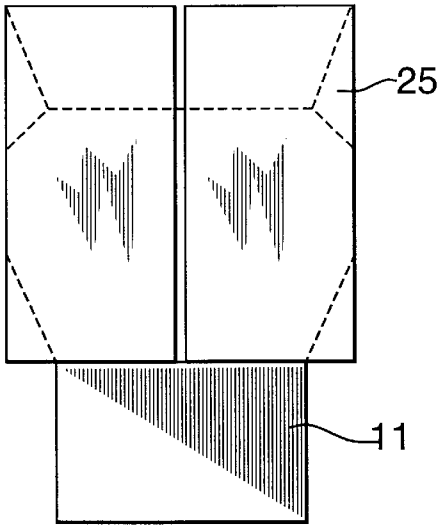
FIG. 3 is an end elevation of the system of FIG. 1.
Figure 2:
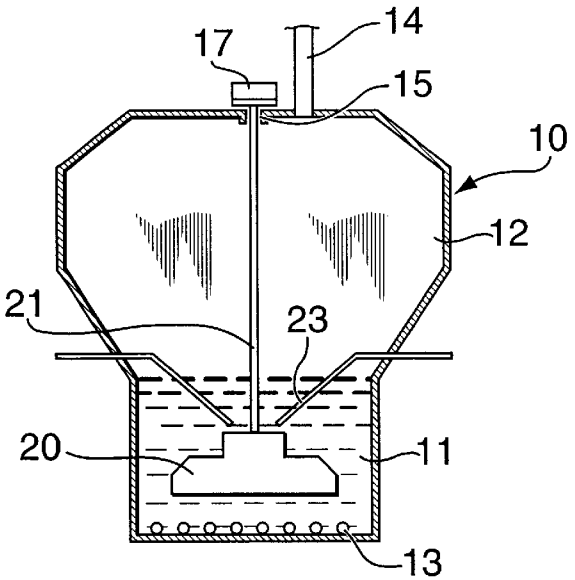
FIG. 2 is a sectional view along line II—II of FIG. 1.

FIG. 1 is a somewhat schematic elevational view of the system according to the invention, while FIG. 2 shows a more detailed cross-section. The cooling chamber 10 consists of a lower fluidised bed section 11 and an upper free board space 12. In a typical commercial installation, the fluidised bed portion 11 has a height of about 1 to 1.3 m (3.3 to 4.3 ft), while the free board space 12 has a height of about 1.5 to 2 m (5 to 6.6 ft). Air inlets 13 extend across the bottom of the fluidised bed region 11 for fluidising the alumina particles contained within the bed 11. An exhaust pipe 14 connects to a plant exhaust system (not shown).

A narrow slot 15 extends along the length of the cooling chamber and this slot permits the passage of anode rods 21 which are connected to the anode butts 20. The anode rods are connected to carriers 17 which travel on a continuous conveyor track 18 located directly above the slot 15. As seen in FIG. 1, the conveyor track includes inclined portions 18*a* at each end of the cooling chamber 12 which serve to lower the anode butts 20 into the fluidised bed at one end of the bed and remove the anode butt at the other end of the bed.

Figure 4:
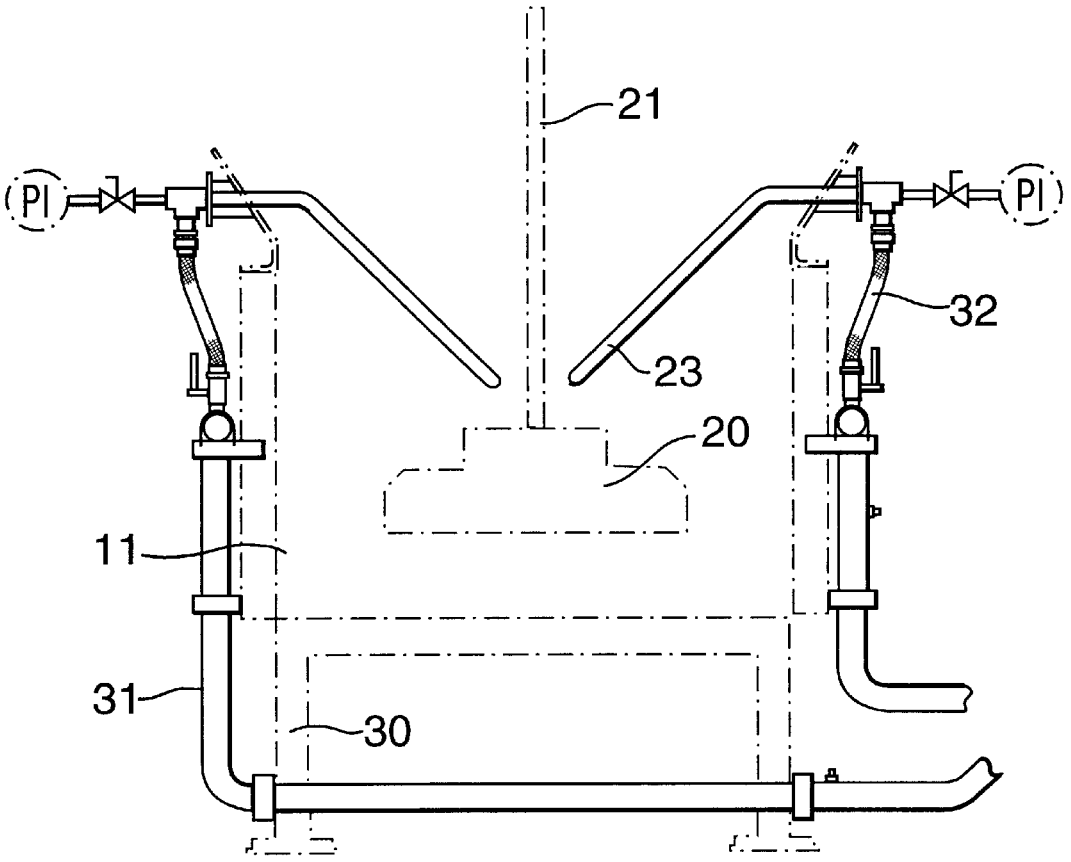
FIG. 4 is a partial sectional view of a cooling chamber.
Figure 5:
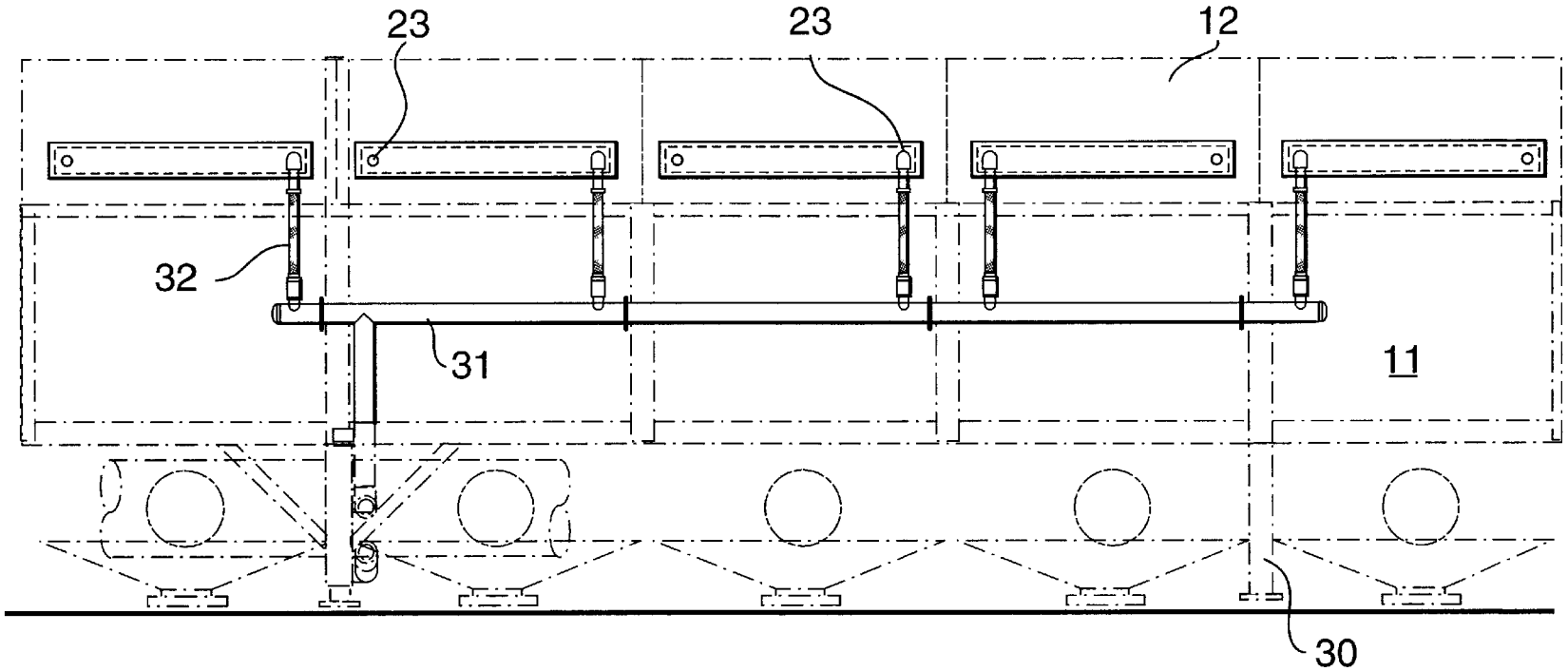
FIG. 5 is a partial side elevation of a cooling chamber according to the invention.

A plurality of nozzles 23 connected to air tubes 22 extend inwardly into the fluidised bed from each side of the cooling chamber. These nozzles are located as shown in FIG. 2 and are positioned approximately 3 to 15 cm (1 to 6 in) above the surface of the anode butt 20. As shown in somewhat greater detail in FIGS. 4 and 5, the tubes 22 are connected to air delivery lines 31 and flexible connector lines 32 mounted on a support frame 30 for the fluidised bed 11.

In a typical commercial installation of the type described above, hot anode butts are delivered as quickly as possible from the pot room to the fluidised bed cooling chamber and passed through the fluidised bed within a time of approximately 2 hours. Fluidising air is fed into the cooling chamber at a rate of about 5.7 to 10.8 $m^3$/min per $m^2$ of bed surface (21.5 to 40.9 scfm/$ft^2$ of bed surface), with about 4.8 to 10.2 $m^3$/min per $m^2$ of bed surface (18.3 to 38.7 scfr/$ft^2$ of bed surface) passing through the lower air distributor and about 0.6 to 0.9 $m^3$/min per $m^2$ of bed surface (2.2 to 3.2 scfm/$ft^2$ of bed surface) passing through the upper air distributor. The bed of alumina comprises approximately 875 kg/$m^2$ (179 lb/$ft^2$) of bed surface and the alumina is replaced at a rate of up to about 42 kg/h/$m^2$ (8.6 lb/h/$ft^2$) of bed surface. Dust is collected in the exhaust in an amount of about 10 kg/h/$m^2$ (2.0 lb/h/$ft^2$) of bed surface. The fluidising air temperature is not critical but is preferably as cool as possible.

The anode butts emerging from the cooling chamber are allowed to sit in the open air for about 4 to 12 hours and are then placed on a vibrating table where they are vibrated for a period of about 2 to 3 minutes to remove the bath layer crust. It is advantageous to break away the bath layers between the studs before cleaning on the vibrating table. Following the cleaning on the vibrating table, the butts are cleaned using a conventional butt cleaning system.

Figure 9:
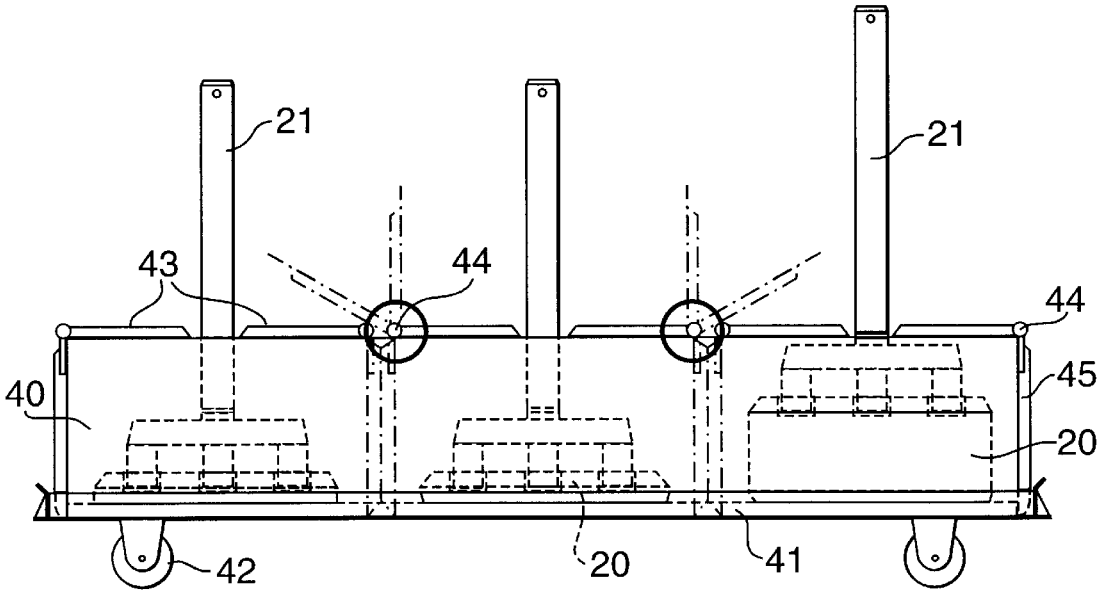
FIG. 9 is a partial sectional view of a hot butt conveying device.

One example of a suitable closed transport container for hot spent butts is shown in FIG. 9. This includes closed compartments 40 for holding individual anode butts 20, these compartments 40 being supported on a frame 41 on wheels 42. The compartments have side walls 45 and top opening doors 43 on hinges 44. With this arrangement, the doors are opened into an open position and the hot butt is set down into the container while being held by the rod 21. The doors 43 are then closed snugly around rod 21 to minimize contact between the hot butt and atmospheric air. When the carrier has been positioned at the inlet end of the fluidized bed cooling chamber, the butt is lifted out of the container and then carried along through the fluidized bed.

EXAMPLE 1

Tests were conducted on the effectiveness of a fluidised bed cooling system on hot anode butts immediately upon their removal from a commercial pot line. The fluid bed cooling chamber had the configuration shown in FIG. 2.

During this series of tests, the fluidised bed was operated under the following conditions:

a) height of alumina (without fluidisation)=85 cm (33.5 in);

b) weight of alumina in the bed=3200 kg (800 kg/$m^2$);

c) fluidising pressure during continuous operation=1.0–1.4 psi (6.89–9.65 kPa);

d) fluidising pressure during start-up=2.4 psi (16.55 kPa); and e) fluidising air flowrate=1080 scfm (270 scfm/$m^2$) in the lower distributor and 200 scfm (50 scfm/$m^2$) in the upper distributor.

The ambient air temperature during the tests varied between 14 and 18° C. (57 and 64° F.) throughout the day.

Two anodes were placed side-by-side in the fluidised bed with a gap of between 10 to 25 mm (0.4 to 1.0 in) between them, in order to simulate as closely as possible the cooling of a twin block anode. Six cooling tests were carried out consecutively so that the fluidised bed operated continually throughout a day. Throughout the test program, the time delay between cold butt removal from the bed, to new hot butt entry into the bed was only 10 to 15 minutes. The test conditions and the resident times are shown in Table 1 below:

TABLE 1

The 6 consecutive butt cooling tests carried out

| Assembly Condition | Residence time in the fluidised bed (mins) | Time requirement (mins) |
|---|---|---|
| 2 × P-155 anodes, bath layer present, instrumented | 60 | 75 |
| 2 × P-155 anodes, bath layer present | 60 | 75 |
| 2 × P-155 anodes, bath layer present, instrumented | 90 | 105 |
| 2 × P-155 anodes, no bath, instrumented | 60 | 75 |

TABLE 1-continued

The 6 consecutive butt cooling tests carried out

| Assembly Condition | Residence time in the fluidised bed (mins) | Time requirement (mins) |
|---|---|---|
| 2 × P-155 anodes, bath layer present | 120 | 135 |
| 2 × P-155 anodes, bath layer present, instrumented | 120 | 120 |
| TOTAL TIME (mins) | 510 minutes | 585 minutes |

After each of the six butt cooling tests shown above, an alumina sample was taken from the bed. The six alumina samples taken were analysed in order to determine their particle size distribution and chemistry. After each butt cooling test, the height of the alumina (without fluidisation) in the fluidised bed was measured, and the weight of alumina lost from the bed calculated using the cross-sectional area of the bed—2 m×2 m (6.56 ft ×6.56 ft)—and packing density of the alumina—948 kg/m$^3$ (59 lb/ft$^3$). A sample of the initial alumina placed in the bed at the start of the tests was also submitted for analysis.

The levels of carbon, iron (as $Fe_2O_2$), fluorine, sodium (as $Na_2O$) and calcium (as CaO) were measured in the alumina samples collected from the fluidised bed, as well as from a dust collector. The results of these analyses are given in Table 2 below:

TABLE 2

Chemistry of the alumina samples collected during the study

| | Fresh alumina | Alumina from bed | Alumina collected by the dust collector |
|---|---|---|---|
| wt % Carbon | 0.032 | 0.079 (std. dev. 0.015) | 0.280 (std. dev. 0.063) |
| wt % $Na_2O$ | 0.410 | 0.434 (std. dev. 0.014) | 0.549 (std. dev. 0.077) |
| wt % $Fe_2O_3$ | 0.008 | 0.009 (std. dev. 0.002) | 0.027 (std. dev. 0.008) |
| wt % CaO | 0.044 | 0.047 (std. dev. 0.002) | 0.066 (std. dev. 0.010) |
| wt % F | <0.1 | 0.122 (std. dev. 0.042) | 0.320 (std. dev. 0.172) |

The above results show that there was no significant contamination of the alumina in the bed, nor of the alumina collected by the dust collector. The level of carbon in the alumina collected by the dust collector was very low at 0.28% The slight increase in iron levels in the alumina collected from the dust collector could be due to wear of the conveyor system in the dust collector.

Figure 6:
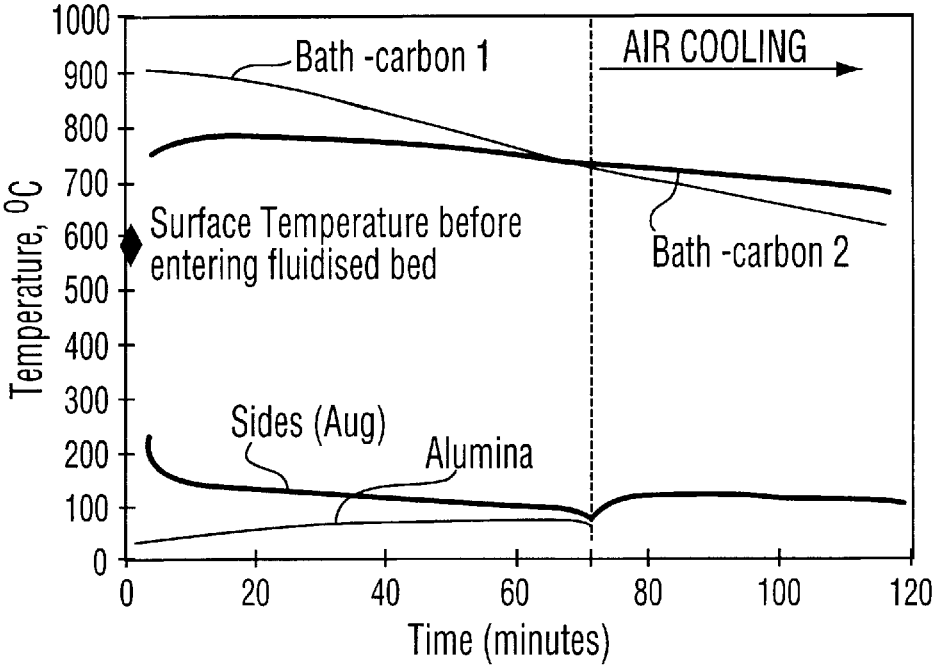
FIGS. 6, 7 and 8 show plots of temperature v. time for the cooling of anode butts.

FIG. 6 shows the results of the first butt cooling test. In this figure, the line for the butt surface temperatures is shown as an average for the inner sides, outer sides and under sides of the two butts and it can be seen that the butt surface temperatures are reduced to less than 200° C. (392° F.) within 72 minutes of cooling in the fluidised bed. It can also be seen that the surface temperatures drop extremely rapidly, from 600° C. (1112° F.) to less than 300° C. (572° F.), within the first 5 minutes of cooling. Bath-carbon interface temperatures were not found to be reduced as rapidly as the butt surface temperatures. For one anode, the bath-carbon interface temperature was reduced by 150° C. (302° F.) in 72 minutes, while for the other butt, the bath-carbon interface temperature was not reduced and showed a slight increase. This temperature rise is thought to be due to heat generated locally around the thermal couple due to oxidation of the carbon. Upon removal from the fluidised bed, the surface temperatures of the anode increased. The maximum surface temperature obtained by the butts upon removal from the fluidised bed never exceeded 300° C. (572° F.).

Figure 7:
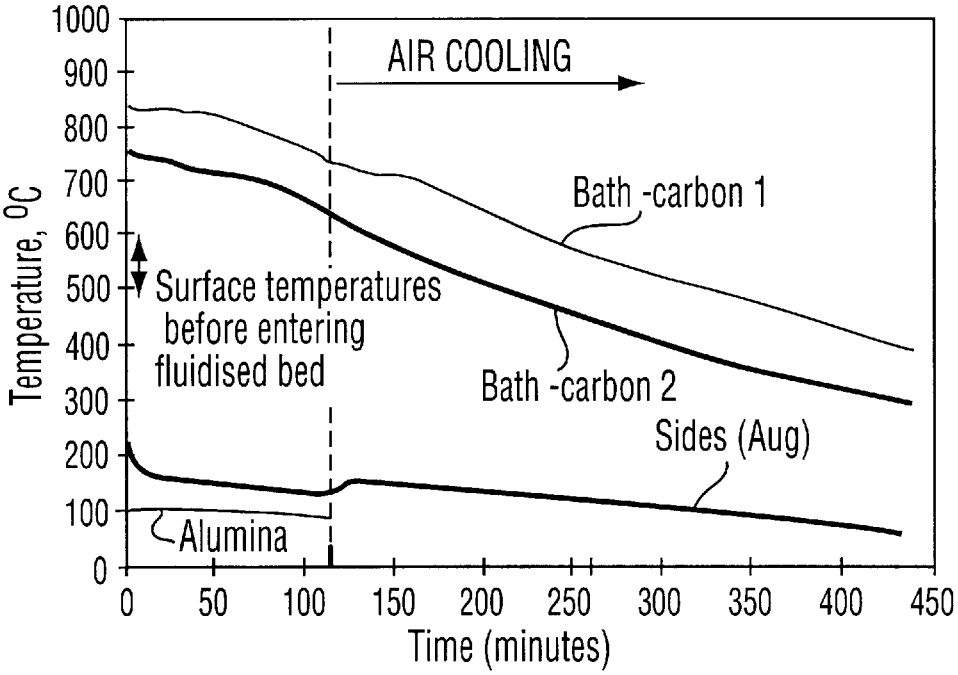

FIG. 7 shows the results of the fourth butt cooling test. For this test, the bath layer was removed prior to cooling. It can be seen that the surface temperatures were rapidly reduced, from 550° C. (1022° F.) to less than 200° C. (392° F.) within the first two minutes of cooling in the fluidised bed. After 55 minutes in the fluidised bed, all surface temperatures were below 150° C. (302° F.). Upon removal from the bed, the butt surface temperatures increased, and the maximum temperature attained did not exceed 200° C. (392° F.).

The top temperature measurements were made by inserting a thermocouple to a depth of one inch into the anode tops between the studs. One anode butt showed a temperature drop of 175° C. (347° F.) in 55 minutes in the fluidised bed, while the other anode butt showed a slight temperature increase. This rise in temperature at the anode butt top indicates that the alumina was not well fluidised in this zone, and that as a result, the rate of cooling was poor and that due to the presence of air, heat may have been generated locally due to the oxidation of the carbon.

Figure 8:
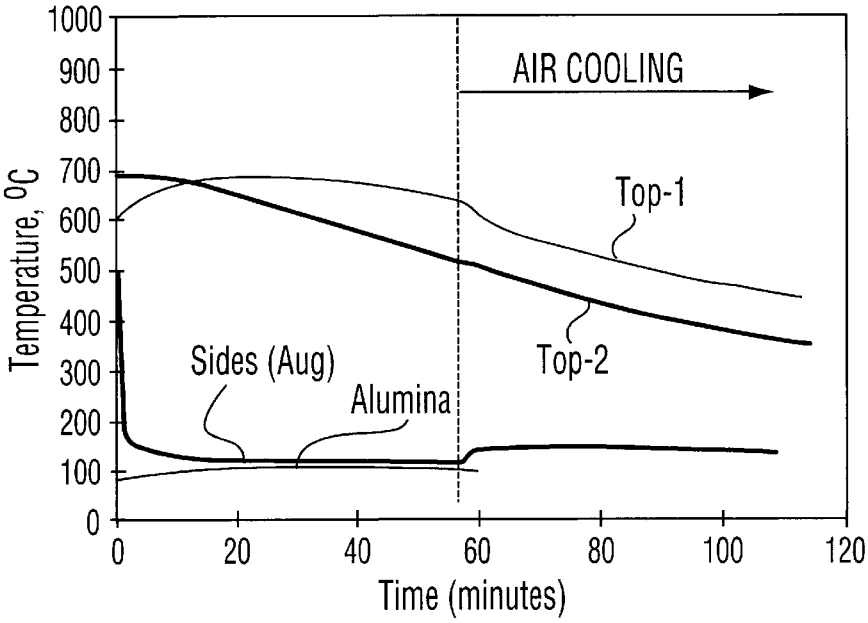

FIG. 8 shows the butt cooling curves for the sixth test where the anodes were cooled for two hours with the bath layer present, and when the bed was operated under equilibrium operating conditions. Once again, it can be seen that the butt surface temperatures were rapidly lowered to below 200° C. (392° F.) in the first 5 minutes of cooling. The bath-carbon interface temperatures were reduced by 100 to 130° C. (212 to 266° F.) after two hours of cooling in the fluidised bed. After the two hours of cooling in the fluidised bed, the anodes removed and cooled in ambient air. It can be seen that the butt surface temperatures did not rise above 200° C. (392° F.) after being removed from the bed and that the bath-carbon interface temperature continued to fall at a rate of approximately 60° C./hour (108° F./hour). After two hours cooling in the fluidised bed followed by 5.5 hours cooling in the open air, the butt surface temperatures were found to be all less than 120° C. (248° F.), and the bath-carbon interface temperature was found to be at 300–400° C. (572–752° F.).

EXAMPLE 2

Tests were conducted using vibrating table technology to determine the most effective way of removing encrusted bath material from the hot anode butts. The vibrating table technology was provided by AISCO Systems Inc.

(A) Butt Cleaning Before Fluidised Bed Cooling

The purpose of this test was to take a hot anode butt 15 minutes after it had been removed from the pot, to remove the hot bath using the vibrating table, and then to cool the butt in the fluidised bed. The butt was vibrated for two minutes and almost 100% of the bath was removed. The butt with the bath removed was then cooled in the fluidised bed as described in Example 1. It was found that the surface temperatures of the anode butt remained under 310° C. (590° F.) after a residence time of only one hour in the fluidised bed. Thus, butt cooling with the bath removed is very rapid.

(B) Butt Cleaning After Fluidised Bed Cooling

The purpose of this test was to take a hot butt 15 minutes after it had been removed from the pot, to cool the butt in the fluidised bed and then to remove the bath using the vibrating table.

Just before being placed in the fluidised bed, the temperatures of the two butts were measured. For the first butt the temperature of the carbon-bath interface was 910° C. (1670° F.) and the second was 915° C. (1679° F.). The temperature of the under side surface of the first butt was 600° C. (1112° F.), while that of the second butt was 645° C. (1193° F.).

The butts were cooled for one hour in the fluidised bed with an air flow rate in the bed of 410 scfm (11.6 $m^3$/min) and 125 scfm (3.5 $m^3$/min) in the upper air distributor. Upon removal from the fluidised bed, one of the two anodes was immediately cleaned using the vibrating table. The other anode butt was used to measure the surface temperatures of the carbon and bath after cooling in the fluidised bed. Directly upon removal from the fluidised bed, the temperature of the butt-bath surface was 461° C. (862° F.) and this temperature increased to a maximum of 546° C. (1015° F.) after 33 minutes. After 40 minutes from being removed from the fluidised bed, the surface temperature of the butt carbon was stabilized to values in the range of 126 to 214° C. (259 to 417° F.), while the surface temperature of the bath had stabilized to values in the range of 215 to 327° C. (419 to 621° F.). At times greater than 40 minutes after fluidised bed cooling, the surface temperatures of the butt carbon and bath began to fall.

The first anode to be cleaned was vibrated directly after being removed from the fluidised bed. The anode was vibrated for three minutes, and 90% of the bath was removed without carbon cracking. The 10% of bath that remained lay in between the studs, underneath the yoke. It should be noted that the interior of the removed bath layer was still red hot, e.g. about 600–700° C. (1112–1292° F.), despite having been cooled in the fluidised bed for one hour.

The second anode to be cleaned was vibrated 40 minutes after being removed from the fluidised bed. This anode was vibrated for two minutes, after which all of the bath was removed without the carbon cracking. It is important to note that in this case too, the interior of the removed bath layer was still red hot, e.g. about 600–700° C. (1112–1292° F.), despite having been cooled in the fluidised bed for one hour.

While the butts can be cooled quicker by first removing the bath material, there are other problems with this procedure. Thus, a high risk exists that hydrogen fluoride will be generated during the removal of the hot bath from the butts. The interior regions of the bath removed were red hot and this red hot bath must be handled and cooled rapidly (or cooled in a dry, inert atmosphere) in order to minimize hydrogen fluoride emissions.

When the hot anode butts are cooled in a fluidised bed and left to cool in air for about 6 hours before removing the bath, the problem of hydrogen fluoride emissions is avoided and a separate bath cooling system is not required. Also, because of longer residence times in the fluidised bed (preferably about two hours) the equilibrium fluidising alumina temperature can be reduced to about 175° C. (347° F.) during continuous operation. Thus, it has been found that even in the worst case scenarios, service temperatures fall below 300° C. (572° F.) after two hours of cooling in the fluidised bed, even though the core temperatures remain high. For this reason, it is preferable to let the butts cool for an additional 4 to 12 hours in air. During this air cooling time the surface temperatures do increase somewhat but the mean surface temperatures do not rise above 300° C. (572° F.) and the mean bath temperature falls below 300° C. (572° F.). After 4 to 12 hours of air cooling it is, therefore, safe to remove the bath using the vibrating table technology, without the risk of hydrogen fluoride emissions. The other advantage of removing the bath when the bath temperatures are less than 300° C. (572° F.) is that the efficiency of cleaning seems to be better.

What is claimed is:

1. A system for cooling and reducing fluoride emissions from a hot, spent anode butt removed from an electrolysis cell, comprising an elongated fluidised bed cooling chamber, said fluidised bed comprising particles of alumina, conveyor means for transporting a hot, spent anode butt through the fluidised bed, a lower air distributor for injecting fluidising air into the chamber to create the fluidised bed and an upper air distributor adapted to direct fluidised particles into contact with the top of the hot anode butt, whereby the fluidised bed surrounds the hot anode butt and serves to simultaneously uniformly cool the hot anode butt and significantly reduce fluoride emissions from the hot anode butt.

2. A system according to claim 1 wherein the conveyor means comprises a continuous conveyor mounted in an upper region of the cooling chamber and adapted to hold suspended from the conveyor the rod of an anode rod assembly essentially comprising a hot anode butt mounted on a support rod.

3. A system according to claim 2 wherein the continuous conveyor comprises a track supporting moving carriages which hold the anode rod assemblies.

4. A system according to claim 3 wherein the track has inclined sections at each end of the cooling chamber adapted to lower a hot anode butt into the fluidised bed at one end of the chamber and lift the butt out of the fluidised bed at the other end of the chamber.

5. A system according to claim 4 wherein the upper air distributor comprises at least two rows of orifices along the width of an anode butt.

6. A system according to claim 5 wherein the orifices are located about 3 to 15 cm (1 to 6 in) above the surface of the anode butt.

7. A system according to claim 1 wherein the fluidised bed has a volume such that the anode butt occupies about 5 to 30% of the total fluidised bed volume.

8. A system according to claim 7 wherein the anode butt occupies about 5 to 10% of the total fluidised bed volume.

9. A system according to claim 7 which includes exhaust means in an upper region of the cooling chamber adapted to maintain a slight negative pressure within the cooling chamber.

10. A system according to claim 4 which includes doors for closing the ends of the cooling chamber, said doors being adapted to automatically open and close as each anode butt enters and exits the chamber.

11. A system according to claim 1 in combination with a vibrating table for removing residual bath material from the anode butt.

12. A system according to claim 11 wherein the vibrating table is located to receive an anode butt either immediately before the butt enters the cooling chamber or after the butt exits the cooling chamber.

13. A method for cooling and reducing fluoride emissions from a hot, spent anode butt removed from an electrolysis cell, comprising the steps of moving the hot, spent anode butt through an elongated fluidised bed comprising particles of alumina, said fluidised bed including a lower air distributor for injecting fluidising air and an upper air distributor which directs fluidising particles into contact with the top of the hot anode butt whereby the hot anode butt is surrounded by the fluidised bed and continuing the passage of the butt through the elongated fluidised bed whereby the hot anode butt is uniformly cooled and fluoride emissions from the hot anode butt are significantly reduced.

14. A method according to claim 13 wherein the anode butt is cooled to a temperature of no more than about 300° C. (572° F.).

15. A method according to claim 14 wherein the hot anode butt entering the fluidised bed has a temperature in the range of about 700–900° C. (1292–1652° F.).

16. A method according to claim 15 wherein the fluidised bed has a volume such that the anode butt occupies about 5 to 30% of the total fluidised bed volume.

17. A method according to claim 16 wherein the anode butt occupies about 5 to 10% of the total fluidised bed volume.

18. A method according to claim 16 wherein the anode butt has a surface:volume ratio of about 5:30.

19. A method according to claim 18 wherein the ratio is about 9.5:16.5.

20. A method according to claim 15 wherein the residence time of the hot butt in the fluidised bed is at least 2 hours.

21. A method according to claim 20 wherein the anode butt removed from the fluidised bed is air cooled for a further period of about 4 to 12 hours.

22. A method according to claim 21 wherein the anode butt after air cooling is placed on a vibrating table to remove any bath layer/crust remaining attached to the butt.

23. A method according to claim 21 wherein the anode butt prior to entering the cooling chamber is placed on a vibrating table to remove any bath layer/crust remaining attached to the butt.

24. A method for cooling a hot solid workpiece having a surface area to volume ratio in the range of 5 to 30 and an initial temperature of at least 700° C. (1292° F.), comprising the steps of moving the hot solid workpiece through an elongated fluidised bed of particulate material, said fluidised bed including a lower air distributor for injecting fluidised air and an upper air distributor which directs fluidised particles into contact with the top of the hot solid workpiece whereby the workpiece is surrounded by the fluidised bed and continuing the passage of the workpiece through the elongated fluidised bed whereby the hot solid workpiece is uniformly cooled.

25. A method according to claim 24 wherein the workpiece is a carbonaceous material.

26. A method according to claim 25 wherein the fluidised particles are particles of alumina.

27. A method according to claim 26 wherein the workpiece is cooled to a temperature of no more than about 300° C. (572° F.).

28. A method according to claim 27 wherein the fluidised bed has a volume such that the anode butt occupies about 5 to 30% of the total fluidised bed volume.

29. A method according to claim 28 wherein the upper air distributor comprises at least two rows of orifices along the width of the workpieces.

30. A method according to claim 29 wherein the orifices are located about 3 to 15 cm (1 to 6 in) above the surface of the workpieces.

31. A method for cooling and reducing fluoride emissions from a hot, spent anode butt removed from an electrolysis cell, comprising the steps of placing the hot, spent anode butt in a moveable closed transport container to limit contact between the hot butt and atmosphere air, transporting the hot butt in the container to a fluidized bed cooling system, removing the hot butt from the container and moving the butt through an elongated fluidised bed comprising particles of alumina, said fluidised bed including a lower air distributor for injecting fluidising air and an upper air distributor which directs fluidising particles into contact with the top of the hot anode butt whereby the hot anode butt is surrounded by the fluidised bed and continuing the passage of the butt through the elongated fluidised bed whereby the hot anode butt is uniformly cooled and fluoride emissions from the hot anode butt are significantly reduced.

32. A method according to claim 31 wherein the hot butt is covered in a layer of alumina while being transported to the fluidised bed cooling chamber.

* * * * *